US005385119A

United States Patent [19]

Tarulli

[11] Patent Number: 5,385,119

[45] Date of Patent: Jan. 31, 1995

[54] X-RAY POSITIONER AND RESTRAINING DEVICE

[76] Inventor: Joseph R. Tarulli, 6325 Eaton St., Hollywood, Fla. 33024

[21] Appl. No.: 54,076

[22] Filed: Apr. 27, 1993

[51] Int. Cl.[6] ..... A61D 3/00

[52] U.S. Cl. ..... 119/755; 378/209; 5/601

[58] Field of Search ..... 119/102, 103, 96; 128/869, 870; 269/45, 55, 59, 74, 111, 244

[56] References Cited

U.S. PATENT DOCUMENTS

| | | | |
|---|---|---|---|
| 986,879 | 3/1911 | Wallis | 119/102 |
| 1,055,953 | 3/1913 | Tanabe | 119/103 |
| 1,980,848 | 11/1932 | Cass . | |
| 1,991,633 | 2/1935 | Serpico | 119/96 |
| 3,023,734 | 3/1962 | Schaub | 119/103 |
| 3,215,834 | 11/1965 | Tayman . | |
| 3,286,694 | 11/1966 | Landy . | |
| 3,484,096 | 12/1969 | Briggs . | |
| 4,693,212 | 9/1987 | Black | 119/103 |
| 4,693,212 | 9/1987 | Black . | |
| 4,742,822 | 5/1988 | Guerriero | 128/870 |
| 4,911,106 | 3/1990 | Goodwin . | |

*Primary Examiner*—Gene Mancene
*Assistant Examiner*—Thomas Price
*Attorney, Agent, or Firm*—Herbert L. Lerner; Laurence A. Greenberg

[57] ABSTRACT

An animal restraining device for restraining an animal on a flat support surface is disclosed. Elongated bar members extend substantially parallel to the flat support surface. Clamps are attached to the ends of the bar members for clamping the elongated bar members stationary with respect to the flat surface. The clamp means include a support surface to be placed on the flat surface for supporting the bar members in a spaced relationship from the flat surface and a clamping surface for clamping against an edge surface of the support. The length of the bar members may be adjusted and hence a distance between the clamping surfaces of mutually opposite clamps. Tie-down straps are provided for fastening the limbs of the animal to the bar members. In an alternative embodiment, the restraining device is a frame placed on the support table, with supports to raise the frame above the table.

8 Claims, 4 Drawing Sheets

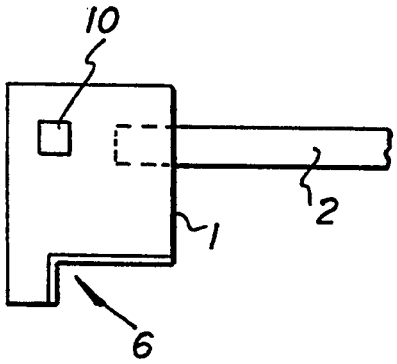
FIG. 3
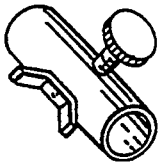
FIG. 4a
FIG. 4b
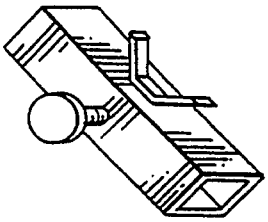
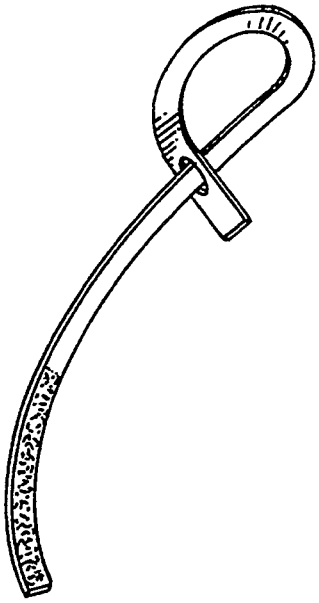
FIG. 5

X-RAY POSITIONER AND RESTRAINING DEVICE

BACKGROUND OF THE INVENTION

1. Field of the Invention

The invention relates to an X-ray positioner and restraining device, and in particular to a restraining device for radio-logical exposure in veterinary practice.

X-ray positioners are generally used in veterinary medicine. Specifically in radiology it is particularly important to properly position the patient or pet, or a part of the patient or pet, on the X-ray table, so that the persons performing the procedure to leave the room during the X-ray or radiography exposure. It is quite important during exposure, to maintain proper precise anatomical positioning of the body part to be X-rayed or radiographed. Furthermore, during the set-up procedure, the respective body part must be positioned properly so as to attain the correct view of the part to be X-rayed.

2. Description of the Related Art

An X-ray table of the general kind is disclosed in U.S. Pat. No. 1,980,848 to Cass. Several adjustability features are provided by Cass. It is seen, however, that the table is quite bulky and it is limited in its applications. Properly exact positioning of limbs is not possible and the table is mobile only to a limited extent.

The infant immobilizer disclosed in U.S. Pat. No. 3,215,834 provides for only limited adjustability, in that it is provided specifically for infants.

In general, prior art X-ray positioning devices are permanently attached to the X-ray table, they are bulky and do not allow for easy manipulation and preparation of the incapacitated patient for radiation exposure.

SUMMARY OF THE INVENTION

It is accordingly an object of the invention to provide an X-ray positioner and restraining device, which overcomes the hereinafore-mentioned disadvantages of the heretofore-known devices of this general type and which provides a quick, easy, efficient method of positioning the patient or pet for quality X-rays or radiographs. A still further object is to provide a device which will be movable to any area of the X-ray table top, which will be easily stowed away and which is easily assembled and disassembled.

With the foregoing and other objects in view there is provided, in accordance with the invention, an animal restraining device for restraining an animal on a support having a substantially flat surface and edge surfaces, comprising elongated bar members extending substantially parallel to the flat surface; clamp means attached to ends of the bar members for clamping the elongated bar members in a rigidly stationary relationship with the flat surface, the clamp means including a support surface to be placed on the flat surface for supporting the bar members in a spaced relationship from the flat surface and a clamping surface for clamping against an edge surface of the support; and adjusting means for adjusting a length of the bar members and a distance between the clamping surfaces of mutually opposite clamp means.

In accordance with an added feature of the invention, the restraining device includes strap means for fastening limbs of an animal to the bar members, and attachment means disposed on the bar members for allowing attachment of the strap means thereto.

In accordance with an additional feature of the invention, the attachment means include a bushing slidably disposed on the bar members, a cleat-like attachment member for attaching the strap means to the bushing, and locking means for locking the bushing in position on the bar member. Alternatively, the attachment means include a section of hook-and-loop fastener disposed on the bar members, and the strap means include a matching section of hook-and-loop fastener.

In accordance with a further feature of the invention, the bar members are formed of at least two mutually telescoping elongate members, the adjusting means being means for drawing one of the elongate members into the other of the elongate members.

In accordance with again an added feature of the invention, the drawing means are formed of a bolt extending through one of the clamp means to a distally disposed one of the elongate members, for drawing the distally disposed one of the elongate members towards the one clamp means upon rotating the bolt.

With the objects of the invention in view, there is further provided, in accordance with yet other features of the invention, an animal restraining device for restraining an animal on a support having a substantially flat surface, comprising: a rigid, substantially rectangular frame, the frame including bar members and elbow members connecting the bar members, means for supporting the frame on and spaced apart from the substantially flat surface; and strap means for fastening limbs of an animal to the bar members, and attachment means disposed on the bar members for allowing attachment of the strap means thereto.

In accordance with a concomitant feature of the invention, the restraining device includes suction cups disposed on the supporting means for fixing the frame in position on the flat surface.

Other features which are considered as characteristic for the invention are set forth in the appended claims.

Although the invention is illustrated and described herein as embodied in an X-ray positioner and restraining device, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 3 is a cross-sectional view of a clamp;

FIG. 4*a* and 4*b* are perspective views of two tie fasteners;

FIG. 5 is a perspective view of a tie-down strap;

DESCRIPTION OF THE PREFERRED EMBODIMENTS

Figure 1:
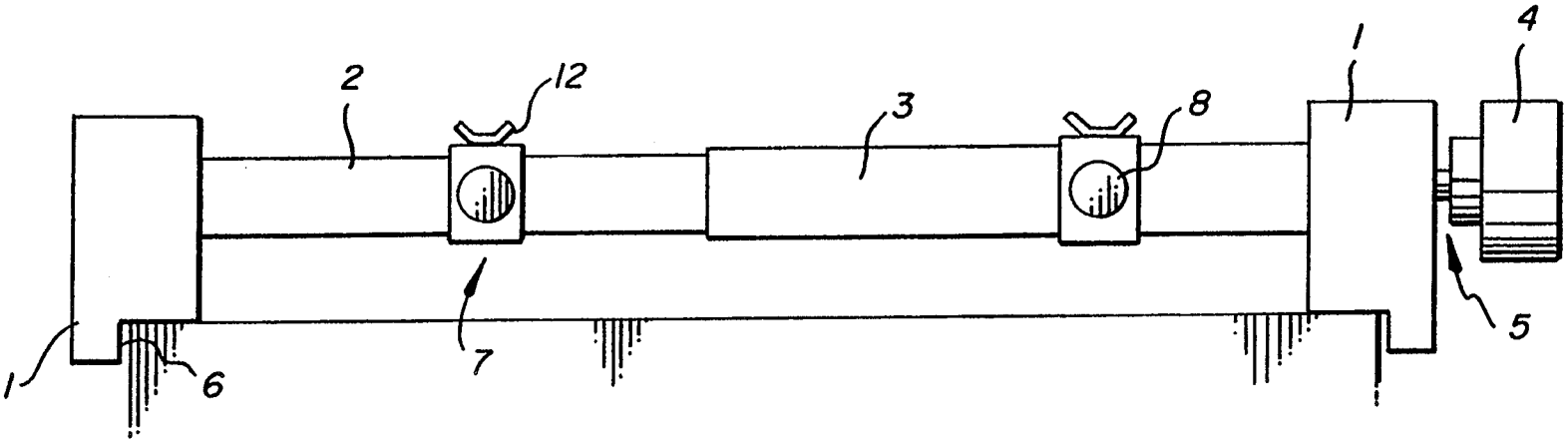
FIG. 1 is a side-elevational view of a table-top X-ray positioner according to the invention.
Figure 8:
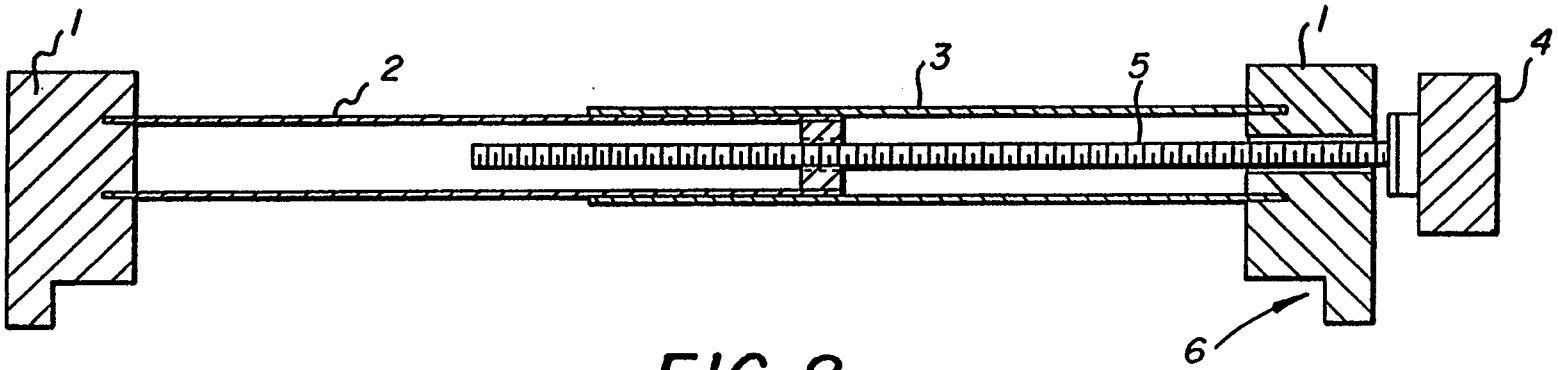
FIG. 8 is a cross-sectional view of the embodiment of FIG. 1.

Referring now to the figures of the drawing in detail and first, particularly, to FIG. 1 thereof, there are seen clamps 1 which are interconnected by horizontal bars 2 and 3. The horizontal bar 2 telescopingly slides within the horizontal bar 3. The width of the device is adjustable by way of a knob 4, which actuates a bolt 5 reaching into a non-illustrated internal thread in the horizontal bar 2. It is thus seen that tightening of the bolt 5, for instance by turning the knob 4 clockwise, pulls the bar 2 farther into the bar 3, which shortens the distance between the clamps 1.

The clamps 1 are rigidly fastened to the bars 2 and 3, respectively. The clamps 1 are each provided with recessed sections 6 having two mutually perpendicular surfaces, one for supporting the clamp 1 on a horizontal surface such as a table top, and the other being the clamping surface for clamping the device against lateral surfaces of the table top. As mentioned above, by turning the knob 4 clockwise, the clamps are forced in a direction approaching one another. This results in a force-locking connection at the lateral surfaces of the table. It is noted, in this context, that a force-locking connection is one which connects two elements together by force external to the elements, as opposed to a form-locking connection which is provided by the shapes of the elements themselves. The recessed region 6 may be provided with friction padding or protective surface padding.

Tie fasteners or brackets 7 are slidably disposed on the horizontal bars 2 and 3. The tie fasteners 7 may be made stationary by turning a knob 8, which threads a bolt against the bars 2 or 3. Exemplary tie fasteners 7 are is illustrated in FIGS. 4*a* and 4*b*.

Figure 2:
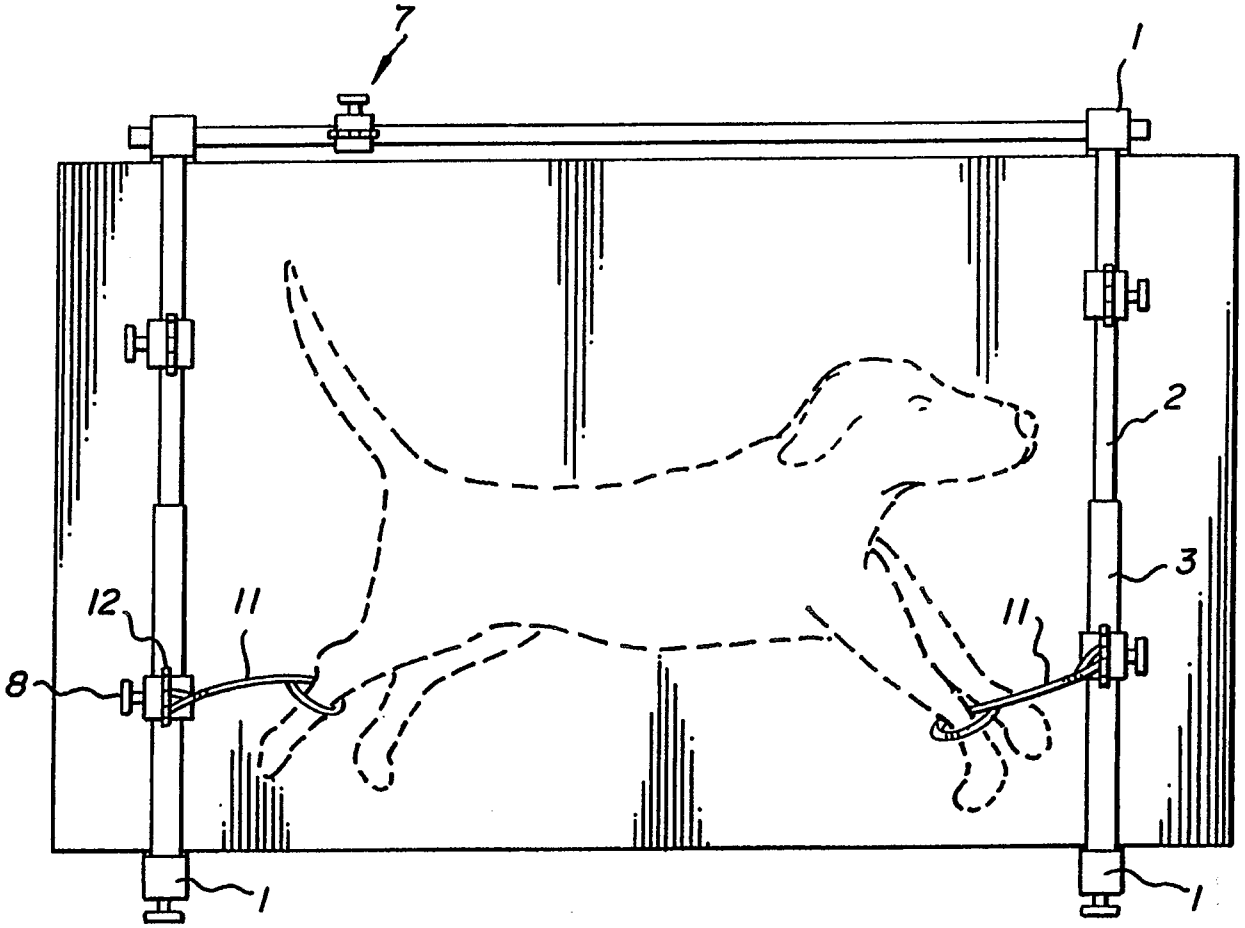
FIG. 2 is a top-plan view of the positioner of FIG. 1, showing a pet in a ready position for an X-ray.

With reference to FIG. 2, a pet is placed on the table surface. Naturally, the pet is under general anesthesia. A transverse rod 9 connects two identical clamp assemblies of FIG. 1. The rod 9, which may be telescopingly adjustable or which may be simply slidable in the clamps 1, is provided with one or more tie fasteners 7 as well.

With reference to FIG. 3, the clamp 1 is provided with an opening in which the tubing of the horizontal bar 2 is rigidly attached. Such attachment may be effected by welding or by threading the bar 2 into the opening. An additional opening 10, extending through the clamp 1, is provided for the transverse rod 9. As illustrated, the rod 9 may be formed of ½ inch square tubing.

With reference to FIG. 4, the tie fastener 7 is respectively adapted to the shape of the transverse rod 9 or to that of the horizontal bars 2 and 3. A bolt, which is turned by the knob 7, meshes in a threaded opening extending to the inside of the shell-like tie fastener 7. In this way, the tie fastener 7 is fastened on the respective rod.

With reference to FIG. 5, a tie strap or positioning strap 11 is provided with a hook-and-loop section (e.g. VELCRO) and with a self-closing loop. The strap 11 is attached to cleats 12 provided on the tie fasteners 7.

Figure 6:
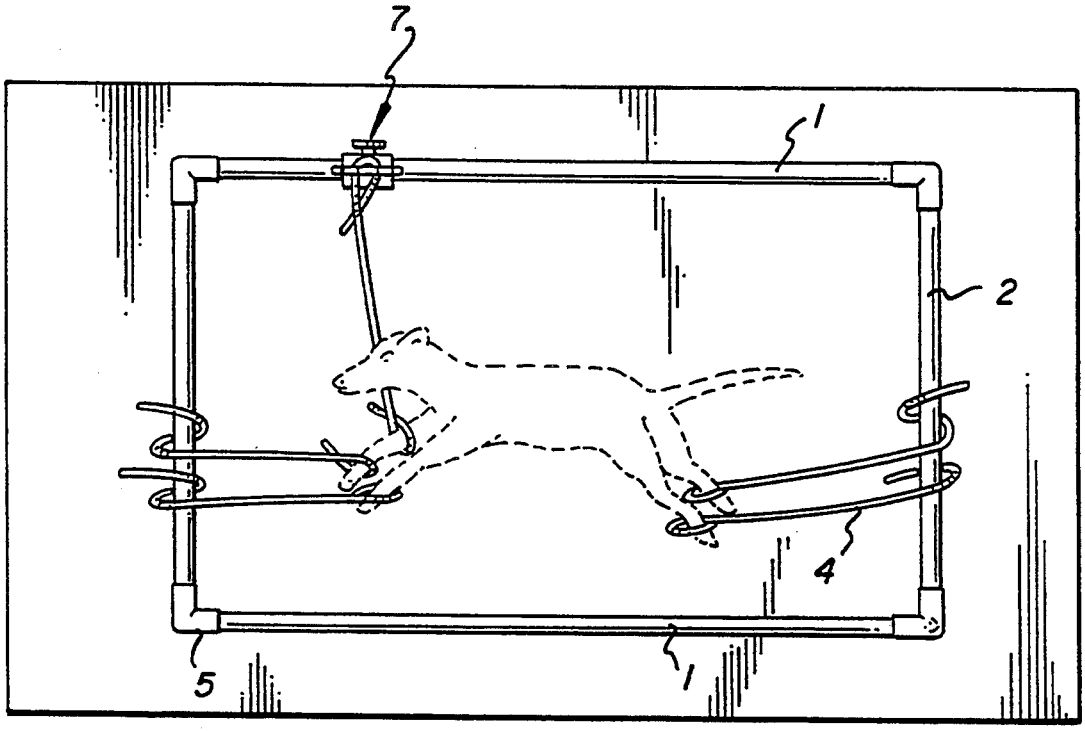
FIG. 6 is a top-plan view of a second embodiment of the invention.
Figure 7:
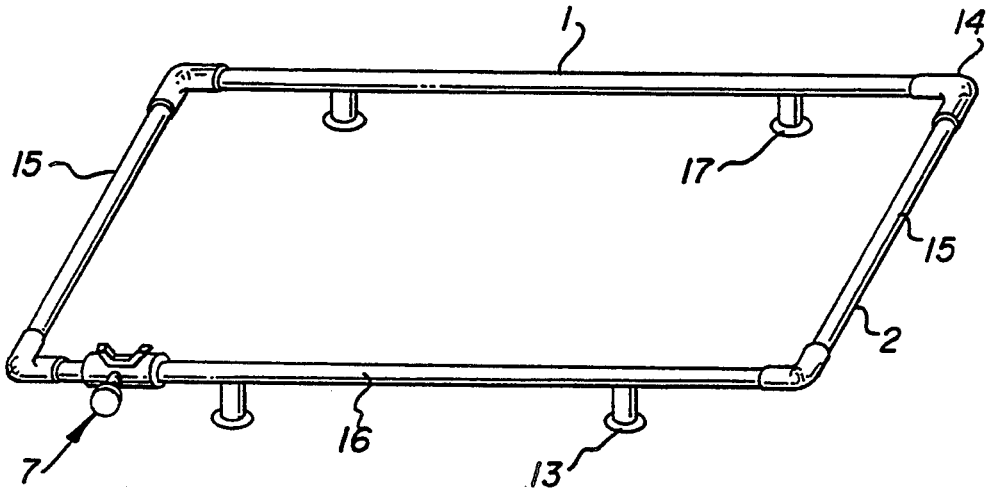
FIG. 7 is a perspective view of the second embodiment.

A second embodiment of the invention is illustrated in FIGS. 6 and 7. A restraining frame is approximately rectangular. In contrast to the embodiment of FIGS. 1 and 2, the width and the length need not be adjustable. The restraining frame may be compared to a picture frame which is raised above the support surface by stands 13. Four substantially identical corner pieces or elbows 14 interconnect mutually perpendicular bars 15 and 16. Tie fasteners 7 are strategically distributed about the bars 15 and 16. In a preferred embodiment, the stands 13 are provided with suction cups 17, so as to ensure proper placement of the device on the supporting surface such as an X-ray table throughout an exposure procedure.

It is understood that materials used for the above-described components may vary widely. By way of example, however, it would be recommended to provide four lengths of stainless steel tubing approximately ½" in diameter for the bars 15 and 16. Four elbows 14 are constructed of brushed aluminum. The longer rods 16 are constructed of stainless steel, and may be approximately 36" long. The two shorter rods 15 are constructed of stainless steel and are approximately 18" long. Diameters and lengths may vary, depending on intended use. Additionally, with the vast improvements made in plastics engineering, the rods 15 and 16, and particularly the elbows 14, may be made of plastic.

The adjustable tie fasteners 7 are constructed of brushed aluminum as well. The handle portion of the thumb screw 8 is covered with a plastic, so as to provide easy manipulability.

In an alternative embodiment, the resilient strap fastener may be attached to the frame on VELCRO sections provided on the bars 15 and 16. In that case, the tie fasteners with the cleats are no longer necessary and the strap is simply wrapped around the tubing for securing the patient to the device.

The four or more stands 13 are attached to the tubing in such a manner as to raise the device above the table surface approximately ¾". The supports are constructed of rubber.

A loop on the resilient strap is provided for the patient. The hook-and-loop fastener section attaches to the frame.

The positioning of the device on the table top is not limited to any area of the X-ray table, and can be moved anywhere on the table top as desired.

I claim:

1. An animal restraining device for restraining an animal on a support having a substantially flat surface and lateral surfaces, comprising:

elongated bar members extending substantially parallel to the flat surface, said bar members having ends;

clamp means attached to said ends of said bar members for clamping said elongated bar members in a rigidly stationary relationship with the flat surface, said clamp means including a support surface to be placed on the flat surface for supporting said bar members in a spaced relationship from the flat surface and a clamping surface for clamping against a lateral surface of the support;

adjusting means for adjusting a length of said bar members and a distance between said clamping surface of one of said clamp means from said clamping surface of oppositely disposed clamp means; and strap means for fastening limbs of an animal to said bar members, and attachment means disposed on said bar members for allowing attachment of said strap means thereto.

2. The restraining device according to claim 1, wherein said attachment means include a bushing slidably disposed on said bar members, a cleat-like attachment member for attaching said strap means to a bushing, and locking means for locking said bushing in position on said bar member.

3. The restraining device according to claim 1, wherein said attachment means include a section of hook-and-loop fastener disposed on said bar members, and said strap means include a matching section of hook-and-loop fastener.

4. An animal restraining device for restraining an animal on a support having a substantially flat surface and lateral surfaces, comprising:

elongated bar members extending substantially parallel to the flat surface, said bar members having ends;

clamp means attached to said ends of said bar members for clamping said elongated bar members in a rigidly stationary relationship with the flat surface, said clamp means including a support surface to be placed on the flat surface for supporting said bar members in a spaced relationship from the flat surface and a clamping surface for clamping against a lateral surface of the support;and adjusting means for adjusting a length of said bar members and a distance between said clamping surface of one of said clamp means from said clamping surface of oppositely disposed clamp means;

wherein said bar members are formed of at least two mutually telescoping elongate members, said adjusting means being means for drawing one of said elongate members into the other of said elongate members.

5. The restraining device according to claim 4, wherein said drawing means are formed of a bolt extending through one of said clamp means to a distally disposed one of said elongate members, for drawing said distally disposed one of said elongate members towards said one clamp means upon rotating said bolt.

6. An animal restraining device for restraining an animal on a support having a substantially flat surface, comprising:

a rigid, substantially rectangular frame, said frame including bar members and elbow members connecting said bar members, means for stationarily supporting said frame on and spaced apart from the substantially flat surface, said support means including suction cups for rigidly fixing said frame in position on said flat surface; and strap means for fastening limbs of an animal to said bar members, and attachment means disposed on sandbar members for allowing attachment of said strap means thereto.

7. The restraining device according to claim 6, wherein said attachment means include a bushing slidably disposed on said bar members between said elbows, a cleat-like attachment member for attaching said strap means to said bushing, and locking means for locking said bushing in position on said bar members.

8. The restraining device according to claim 6, wherein said attachment means include a section of hook-and-loop fastener disposed on said bar members, and said strap means include a matching section of hook-and-loop fastener.

* * * * *